United States Patent [19]

Weisz

[11] 4,032,431

[45] * June 28, 1977

[54] SHAPE SELECTIVE NAPHTHA PROCESSING

[75] Inventor: Paul B. Weisz, Yardley, Pa.

[73] Assignee: Mobil Oil Corporation, New York, N.Y.

[ * ] Notice: The portion of the term of this patent subsequent to July 30, 1985, has been disclaimed.

[22] Filed: July 16, 1970

[21] Appl. No.: 66,537

Related U.S. Application Data

[63] Continuation of Ser. No. 747,646, July 25, 1968, abandoned, Continuation-in-part of Ser. No. 547,608, May 4, 1966, Pat. No. 3,395,094.

[52] U.S. Cl. ..... 208/62; 208/63

[51] Int. Cl.[2] ..... C10G 37/00

[58] Field of Search ..... 208/62, 63

[56] References Cited

UNITED STATES PATENTS

| | | | |
|---|---|---|---|
| 3,140,251 | 7/1964 | Plank et al. | 208/120 |
| 3,395,094 | 7/1968 | Weisz | 208/65 |
| 3,575,846 | 4/1971 | Hamner et al. | 208/111 |

*Primary Examiner*—Herbert Levine

*Attorney, Agent, or Firm*—Charles A. Huggett; Carl D. Farnsworth

[57] ABSTRACT

A process is disclosed for upgrading a naphtha which has been subjected to a reforming process which involves contacting said reformed naphtha together with added hydrogen with a crystalline aluminosilicate zeolite having a pore size of about 4.5 to 6 Angstrom units and a silica to alumina ratio of at least 3, said aluminosilicate having hydrogenation/dehydrogenation activity. Another embodiment of the invention resides in mixing a reforming catalyst with said crystalline aluminosilicate zeolite.

4 Claims, 2 Drawing Figures

Figure 1:
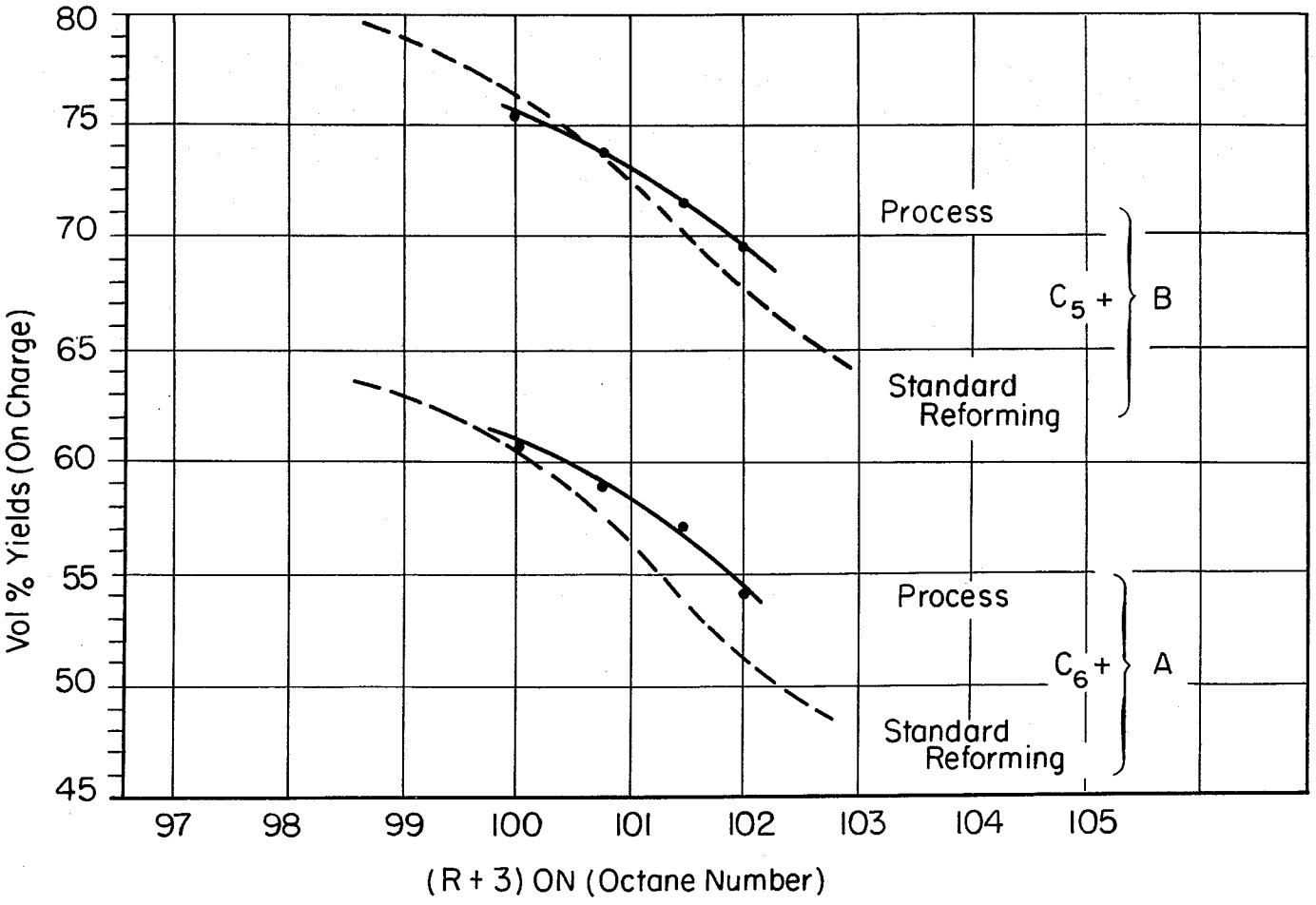

INVENTOR.
Paul B. Weisz

BY
Carl B. Tarasoff
Agent

INVENTOR.
Paul B. Weisz

BY

Agent

SHAPE SELECTIVE NAPHTHA PROCESSING

This application is a continuation of Ser. No. 747,646, filed July 25, 1968 and now abandoned which, in turn, is a continuation-in-part of Ser. No. 547,608, filed May 4, 1966 and now U.S. Pat. No. 3,395,094.

This invention relates to methods and processes for converting petroleum naphthas to aromatic rich products including relatively high octane gasoline products. In one aspect, the present invention is directed to one or more methods for selectively conducting chemical reactions with an arrangement of catalytic compositions possessing particular selective conversion properties with respect to different hydrocarbon components in a naphtha boiling feed. More particalarly, the present invention relates to effecting the selective catalytic conversion of hydrocarbon components comprising ring, normal and iso-paraffin hydrocarbon components in a hydrogen rich conversion process maintained under operating conditions to produce product rich in aromatics, LPG rich gaseous material and/or methane rich gaseous material.

The octane number (ON) of gasoline depends on the character and content of its various hydrocarbon components. Presently practiced processes for obtaining high octane gasolines from naphthas are known to include reforming processes. Of these, the platinum catalytic reforming process is the one most commonly employed. During reforming the gasoline boiling range components of the naphtha boiling above about $C_5$ hydrocarbons are subjected to a plurality of reactions, with isomerization, cyclization, aromatization and hydrogenative cracking as the major resulting transformations. While these reactions all participate in accomplishing a gain in octane number quality, such reforming operations have always been accompanied by a loss of volume of quantity of gasoline boiling range product. As is well known, progressively greater yield losses must be accepted in exchange for improvements in octane quality, as higher process severity is employed, that is, the greater the ON (octane number) quality target is.

It is an object of this invention to provide an improved method and process for upgrading naphtha boiling hydrocarbons.

It is a further object of this invention to produce aromatic concentrates from naphtha boiling hydrocarbon fractions.

It is a still further object of this invention to provide an improved method and process for selectively upgrading the components of paraffin rich naphthas for the production of high volume yield of gasoline product of desired high ON quality in combination with gasiform product rich in LPG product material.

It is a still further object of this invention to selectively upgrade paraffin rich naphthas to an aromatic rich product and gasiform material rich in methane.

Other objects and advantages of this invention will become more apparent from the discussion hereinafter presented.

In accordance with this invention, one or more of the above objectives is accomplished by establishing specific catalytic reaction methods and systems arranged to provide a particularly selective and desirable combination of chemical transformations to occur. The newly selective upgrading operation of this invention hereinafter described will therefore, and for convenience, be termed a selectoforming operation.

The selectoforming operation of this invention comprises contacting a naphtha boiling range starting material with at least two distinctly different catalyst compositions, comprising a platinum type reforming catalyst on the one hand, employed in coopertion with an n-paraffin selective conversion catalyst differing substantially from the platinum type reforming catalyst in chemical composition, structure and purpose. The selective conversion catalyst employed herein is characterized in one aspect by a highly selective ability to convert normal paraffin hydrocarbons in admixture with other hydrocarbons to lower molecular weight saturated gasiform product materials when operating under the selectoforming operating conditions herein described as regards the presence of hydrogen, operating pressure, temperature, vapor residence time, and catalyst residence time. Furthermore, the selective conversion catalyst and operating conditions under which employed provides conversion of normal paraffins to saturated products substantially without the production of olefinic products, whereby continued, regeneration-free operation is possible for the processing of from about 300 to about 3000 or more volumes of naphtha per volume of catalyst. Therefore, the present invention provides on the one hand a gasoline upgrading process wherein the plurality of reactions occurring to components in the naphtha feed are selectively altered in a direction so that reactions resulting in loss of liquid product are now shifted to more selectively involve the lower ON components. Thus, desired target ON are attainable with even a higher than usual desired product yield. On the other hand, the upgrading process of this invention permits the preparation of aromatic concentrates and saturated gasiform products under conditions allowing long-term on-stream time in, for example, a fixed bed operation.

In the selectoforming operations contemplated by this invention, a naphtha charge material boiling in the range of from about $C_5$, and preferably from about $C_6$, up to about 380° F. or higher is passed with hydrogen at least initially in contact with a platinum type reforming catalyst "A" and then in contact with the selective conversion catalyst. Generally, contact with the catalyst types of this invention is arranged to occur substantially sequentially in a suitable reactor system. However, provisions are also contemplated for effecting an initial separation of the reformate effluent to recover lower boiling constituents therefrom before subjecting the remaining higher boiling reformate effluent in the presence of hydrogen to contact with the selective upgrading catalyst.

Platinum type reforming catalyst referred to herein as catalyst "A" for convenience may be selected from a number of the known reforming catalysts of the prior art. They may include, for example, alumina in the eta, chi or gamma form and mixtures thereof in combination with a noble metal. Platinum type includes, for example, the metal series which includes platinum, palladium, osmium, iridium, ruthenium or rhodium and mixtures thereof deposited on a suitable support. Generally, the major portion of the catalyst will be alumina and may comprise as much as about 95% by weight or more of the catalyst. Other components may be combined with the alumina carrier, such as the oxides of silica, magnesium, zirconium, vanadium, titanium, boron or mixtures thereof. The platinum-alumina combination, either with or without one or more of the above-listed components such as silica, etc., may also be promoted with small amounts of halogen such as chlorine and fluorine, in amounts ranging from about 0.1% up to about 5 by weight. Generally, less than about 3% of halogen is employed with the platinum type catalyst. In a preferred embodiment, the reforming catalyst carrier material is a relatively high surface area material, preferably on eta alumina material of at least about 100 square meters per gram. Preparation of the type "A" catalyst may be accomplished by many different procedures described in the prior art. In one procedure an alumina carrier material is impregnated with the acid or salt of one or more of the herein-described platinum type hydrogenating component in amounts that range from a fraction of a percent up to about 1% by weight but generally not substantially more than about 0.6by weight of platinum is employed.

It is to be understood that a naturally occurring or synthetically prepared alumina with or without silica may be employed as a carrier material or support for the platinum type reforming catalyst. Preferably, the platinum-alumina catalyst employed comprises a high surface area material such as an eta base alumina discussed above. Before use, the high surface area platinum catalyst may be reduced in a hydrogen atmosphere and maintained preferably in a relatively dry moisture-free atmosphere before being put on-steam. Desiccated conditions for the catalyst are preferred since it has been found that at a given moisture and certain related temperature level that a relationship exists which decreases the desired high surface area of the catalyst and has a simultaneous deactivating effect on the catalyst. Accordingly, it is preferred to employ in the platinum reforming steps of this invention, relatively dry reforming conditions. This is particularly true, however, when employing relatively low pressure reforming conditions below about 400 psig and not substantially above about 200 psig.

It is to be understood that the term "platinum type reforming catalyst" or type "A" catalyst designates a catalyst which performs the well-known reforming reactions of hydroisomerization and aromatization under conditions creating a negligible concentration of olefins in the effluent product. While the above described catalysts are examples of this class, the platinum type catalyst and term as used in connection with this invention should not be construed to be restricted to a particular chemical composition per se, as regards the platinum type metal nor the base of support material.

For example, it is contemplated using as a "platinum type reforming catalyst", compositions which may include a crystalline alluminosilicate base substance having a pore structure sufficiently large to allow passage therein of substantially all molecules contained in a naphtha charge, and associated with a dehydrogenative element of the transition metal series, and having its acidic catalytic activity adjusted to a relatively low level which is characterized by an alpha value of less than 1.0 and preferably of about 0.01 to 0.1. The alpha scale and measurement has been described in publication in the Journal of Catalysis, Volume 4, Number 4, August 1965, Pages 527 to 529. In the case of catalysts with associated dehydrogenative metal, the alpha test is carried out after suitable poisoning of the metal activity as per advance contact with a sufficiently large amount of hydrogen sulfide. In the above example, the prescribed low level of acidic activity may be achieved by providing a controlled and relatively high concentration of alkali metal ion concentration within the aluminosilicate.

The selective conversion catalyst herein referred to as type "B" catalyst is a porous solid particle material having a majority of its pores of substantially uniform small dimension, large enough to allow uptake and egress of normal paraffin molecules, such as, for example, n-hexane, but too small to allow a similar uptake of either branched chain or cyclic hydrocarbons, such as, for example, methylpentane, cyclohexane or benzene. Accordingly, the selective catalytic material, type "B" is a highly porous material wherein a substantial majority of its pores are of a uniform dimension in the neighborhood of about 4.5 to about 6.0 Angstrom units effective diameter. Type "B" catalyst is essentially a selective hydrocracking catalyst substantially provided with in-pore acid activity cracking sites and in-pore catalytically effective hydrogenation-dehydrogenation sites. In some cases, one of the two functions or types of catalytic sites may be associated with the molecular shape selective material but externally located. The hydrogenation-dehydrogenation component introduced during manufacture of the catalyst, involves one or more of the elements known as the transition metals. Preferably, one or more of the elements of nickel, cobalt, molybdenum, iron, or of the platinum or palladium family are employed. One or more of the elements employed may also involve an element of the higher molecular weight transition series which have hydrogenation-dehydrogenation activity, such as tungsten.

In one embodiment, the catalytically active solid material comprising type "B" catalyst is a modified zeolitic oxide, having a crystaline, rigid and uniform cavity structure of the aforementioned dimensions. Examples are to be found among a number of aluminosilicate minerals, and among synthetically prepared crystalline aluminosilicates which have structure analogous to, and sometimes differing from minerals known to occur naturally Chabazite, gmelinite, stilbite, erionite, offretite, epistilbite, desmin, zeolites S, T, A, ZK-4, ZK-5 and others. It is to be noted that the terms erionite and offretite will be considered to be identical in meaning as regards reference to the same or closely equivalent structural mineral form, in accordance with the findings reported in Mineralogical Magazine, Volume 33, Pages 66–67, 1962, by M.H. Hey and E.E. Fejer entitled "The Identity of Erionite and Offretite-38 .

Other porous materials may be employed provided they possess the above described characteristic pore dimensions. Thus, for example, porous carbons can be employed which have undergone suitable treatment to convey to them pore dimensions in the desired range of from about 4.5 to about 6.0 Angstroms.

These solids of desired porosity are modified to produce useful catalyst by introduction of one or more of the above described transistion elements in such a way that a majority of the final quantity of such element is located in the internal porous structure, in contrast to surface deposition on the circumferential surfaces of the individual solid grains or particles.

Introduction of one or more of the metallic catalytic component may be achieved either by processes allowing this component to penetrate the existing or preformed porous solid and be fixed therein, or by formation on synthesis of the porous solid itself in a compositional environment which contains the desired metallic component in suitable form so as to be incorporated in the porous structure in the formation of the porous solid or in the course of its modification to the desired pore structure.

In another aspect of this invention, molecular sieve like carbons can be used to advantage which are produced by heat treating to pyrolitic temperatures, high polymer materials such as polyvinylchloride, polyvinylidine chloride, polystyrenes, polystyrenes containing halo-, sulfonate or other groups on the aromatic nuclei, polymers from monomeric units containing elements or groups comprising elements from groups VI and VII of the Periodic Table. Thus, for example, suitable porous carbons can be produced from Saran polymer at high temperatures. Methods have been described by Dacey and Thomas in the Transactions of the Faraday Society, Volume 50, 1954, beginning with Page 740; and by Lamond, Metcalfe and Walker, in Carbon, Volume 3, 1965, beginning with Page 59. Other organic polymers may also serve as starting materials such as coals, anthracite and other carbonaceous solids that can be converted to suitable porous solids similar to the base material used for the B type catalyst herein described.

It is further contemplated that specific qualities in the design and contribution of the B type catalyst component in cooperation with specifically chosen process conditions are particularly preferred to impart unusual economies and stability of performance to the selectoforming process. Thus, the acidity of the type B catalyst solid or solid composite, if any, in the type B reaction zone will preferably be maintained within desired limits, and these limits will bear a correlation to the temperature of operation employed therein.

Accordingly, it is preferred to impart the type B catalyst with certain magnitudes of acid catalytic activity. For example, when LPG product is preferred over methane, the preferred acid activity will have an alpha value in excess of 10. If the selectoforming process employs the catalyst at a temperature of 900°F. or higher, a more preferred acidity level is between 5 and 300 alpha; for operation more nearly at 800° F., above about 500 alpha, for operation near 700° F., above about 2000 alpha. A very practical method of assaying the alpha acidity of the type B catalyst is that of testing its n-hexane cracking activity under conditions of cracking, in the absence of hydrogen. Such a procedure in fact constitutes the procedure of the alpha test, as outlined in a previously cited publication.

In order to achieve the required activity level without exceeding the preferred range, for purposes of operating stability, the following types of catalyts or procedures for making same, constitute preferred examples:

Suitable crytalline aluminosilicates, such as desmine, ZK5, described in U.S. Pat. No. 3,140,251, erionite, chabazite, and others, may be prepared having an appreciable fraction of cation sites occupied by hydrogen —or hydrogen precursor cationic form such as ammonium, prior to any calcination-, an appreciable fraction by transition metal ions, and the balance by one or more of the alkaline metals or alkaline earth metals.

For example, erionite may be acid treated to remove initial cations and impurities, and subsequently base-exchanged with a solution of Ca-ion, or Mg-ion, or mixture therefore until most of the cation exchange capacity is satisifed by that ion. The transition metal ion may be introduced simultaneously, or by a subsequent exchange process. A more exacting control of the catalyst quality may be achieved by exchange of the zeolite simultaneously with a solution comprising at least one of the ions of each of the two groups comprising in the first group $MG^{2+}$, $CA^{2+}$, $SR^{2+}$, and in the second group $H^+$ and $NH_4^+$, in such proportion as to result in an ultimate product of desired acidity. In every case, the transition metal may also be introduced as described above, that is before, simultaneous with, or after the aforesaid exchange. Extended calcination is indicated for increasing the acidity of $NH_4^+$ containing preparations.

It is also possible to control the acidity of catalyst type B prior to use in a selectoforming operation, or in situ, if overactivity is to be reduced, by contacting limited amounts of ammonia or ammonia producing volatile components with the type B catalyst charge.

In accordance with the invention herein described a naphtha boiling-range charge material is passed over at least two separate and distinct solid catalyst compositions A and B, described above, in the presence of hydrogen, under temperature, pressure and feed-rate conditions characteristic of a platinum-type reforming operation. It is contemplated employing Catalyst A and B in one or more separate catalyst beds located in one of a sequence of separate reactors wherein the order of catalyst loadings are such that the reactant stream initially contacts solid catalyst particles of predominantly type A catalyst prior to contact with solid particles of predominantly type B catalyst. Intermingled mixtures of particles of catalyst A and B may be employed in part of one, two, or more beds in the system. However, contact with type A solid shall again predominate during the early or initial contact portion of the sequence. With this feature in mind, the concentration of Catalyst B in any one bed may amount to an abrupt change or be arranged to increase gradually and in increments within a given reactor or catalyst bed in the direction of reactant flow.

In any of the above arrangements employing separate or an intermingled mixture of identified catalyst A and B, the conversion effected generally will be in a direction tending to favor aromatization of cyclic compounds and elimination of paraffin compounds from naphtha feed. With proper conditions of severity, and a more specific choice of catalyst distribution within the broad characteristics described above, the reaction mechanisms effected in the presence of Catalysts A and B may be controlled and directed either to serve specifically as a process producing primarily an aromatic rich concentrate, or conditions and catalyst distribution may be optimized to create a process producing a motor gasoline of desired high target octane number with relatively high product yield.

When a highly aromatic product is desired, a naphtha feed material boiling in the range presence from about a $C_6$ up to about a $C_8$ hydrocarbon fraction may be chosen as a feed or separate or combined portions thereof may be employed, for the production of benzene, toluene and xylene rich product material. The distribution of Catalysts A and B will be chosen such as to include portions of intermingled components A and B in a downstream portion of hydrocarbon contact. For this purpose of producing an aromatic concentrate, elimination of a major portion of all types of paraffins, that is, both normal and iso-paraffins, is contemplated and the presnce of intermingled catalysts A and B in the sequence has been found to be important. Accordingly, an example of the distribution of catalyst types within a process arrangement using a single reactor comprises employing at the inlet end of the reactor catalyst particles of type A constituting 100% of the fill, while toward the outlet end of the reactor the relative concentration of catalyst B rises up to about 75%. On the other hand, using a two-reactor arrangement, the one first contacted contains only catalyst A, while the second downstream reactor contains both A and B in intermingled admixture of about 50% of each catalyst. It is evident from the above that many variations of catalyst arrangement are possible which incorporate the principal features above described.

When it is desired to produce a motor gasoline product of high target octane number, such as for example, 102 ON (Research, 3 ml TEL), with unusually good product yield, the distribution of catalysts A and B is so chosen as to include a substantially abrupt change of catalyst type A to catalyst type B in the downstream direction of hydrocarbon flow so that substantially no volume exists in which there is any substantial mixing of both catalysts A and B. That is, one example of a suitable catalyst arrangement comprises providing contact with catalyst A in one bed of catalyst followed by contact with type B catalyst in a second portion of catalyst bed within a single reactor. On the other hand, catalysts A and B may be retained in separate catalyst beds in separate reactors so that the reaction product separated from catalyst A will then contact catalyst B in a separate reactor. Furthermore, a bed of catalyst B may occupy only a portion of a downstream reactor of a multi-vessel sequence. These arrangements of catalyst beds all have the common feature, however, that substantial preliminary contact is first achieved over the highest concentration of type A catalyst, before any substantial contact of the charge stream is provided with a concentration of type B catalyst.

Therefore, when an optimum yield/octane number relationship is specifically desired in the production of a high target ON motor gasoline by the selectoforming upgrading process herein described, the catalyst compositions employed are generally arranged to provide the highest concentration of catalyst "B" type in at least the last reactor, bed of catalyst, or last portion of same, when viewed in the downstream direction in which the naphtha feed passes over the total catalyst contact mass.

It is to be understood, of course, that the salient features of this invention are not defeated by the use of other contact operations which may be applied subsequent to the above conversion operation. The use of the highest concentration of "B" type catalyst at the end of the contact train is to be interpreted to mean that no further appreciable isomerization conversion zone follows the contact with the high concentration of B type catalyst. That is, isomerization inducing catalyst, such as ordinary reforming type catalysts need not be used to create deliberate and substantial further conversion following the selectoforming operation. It is permissible, however, to provide further contact or conversion opportunities, if so desired, over solid contact masses which do not offer both an acidic and a hydrogenation-dehydrogenation component in intimate association, and in the absence of molecular shape or size restrictive properties which would in fact and otherwise characterize such material as a type B catalyst. For example, contact with silica-alumina, a solid sorbent, a molecular sieve devoid of internally active dehydrogenative components, a non-selective hydrogenation catalyst, and with other solids may be practiced subsequent to the selectoforming operation without interfering with the principles of the invention. Thus, it is contemplated that the last catalyst bed or portion thereof may contain catalyst type B and also a platinum type component located externally of the intraporous space as previously discussed with respect to catalyst B, but devoid of acid properties which when located externally would provide basis for isomerization conversion. On the other hand, it is comtemplated providing a contact zone containing silica-alumina, or acid zeolite, devoid of hydrogenation-dehydrogenation active metals, downstream of or in admixture with catalyst component B. In particular, a combination or admixture of catalyst B with another acidic solid particle material is contemplated to provide specific characteristics aiding in the promotion of desirable selective conversion of normal paraffins. Examples for such added acidic solids are silica-alumina, silica-zirconia, silica-magnesia, zirconia-alumina, halogen containing alumina, hydrogen and multivalent acidic metal forms devoid of hydrogenation activity such as rare-earth and alkaline earth metal forms of aluminosilicate zeolites like faujasites, mordenites, clinoptilolites, zeolites X, Y, L and others. Such combination of a pore-size selective catalyst containing a hydrogenative metal as previously discussed as characteristic of catalyst B in combination with an acidic solid catalyst material should also be considered to fall within the scope of the definition of type B catalyst of this invention.

The present invention provides an improved and novel method of upgrading a naphtha boiling material to a desired high target ON product in high product yield. The method of this invention encompasses the steps of contacting a naphtha feed with a reforming catalyst under relatively restricted reforming conditions selected to limit the reaction conversion severity to substantially an intermediate high octane number or aromatic concentrate product of relatively high yield having an octane number substantially below the desired product target ON and thereafter contacting the intermediate product material with predominantly type 'B' catalyst to affect further selective conversion to a final aromatic rich product comprising a gasoline boiling range product of desired higher target octane number.

In reforming operations it is known that as severity is increased to achieve higher and higher octane numbers (ON) product, the ON increase is obtained primarily by paraffin isomerization, naphthene aromatization and five carbon ring naphthene aromatization. At relatively high severity conditions, paraffin-to-aromatics dehydrocyclization becomes important and is also accompanied by progressive elimination of remaining paraffins to gaseous products, thus increasing ON at the expense of substantial liquid volume losses. However, by controlling the reforming reaction mechanisms in the manner of this invention. the selectoforming operation, selectively directs the conversion and elimination of the lowest ON compounds in the hydrocarbon fluid, namely its n-paraffin constituents. Accordingly, the selectoforming method and process herein described provides significant and unusual benefits specifically at upgrading levels where high octane numbers are to be achieved. Accordingly, the selectoforming operation herein described is distinguishable from and substantially diametrically opposed to the prior art method of operation which operates through indiscriminate and uncontrolled removal of all types of paraffins from the naphtha feed to be upgraded to high ON levels. In a more particular aspect, the selectoforming operation herein described permits an unusual advantage in product yields when applied to producing gasoline target octane numbers of at least about 98 and preferably at least about 100 ON, and even more particularly for target ON of about 102 or higher (in terms of Research ON, with 3 cc TEL).

The methods of operation and processes herein provided are of a scope that includes in one embodiment the simultaneous production of high ON gasoline product in unusualy high liquid yields and of LPG fuel products. However, the selectoforming operation may also be adjusted to produce either aromatic concentration or high yield of high octane number gasoline as liquid product together with either LPG or with a methane rich gaseous product such as is useful for consumer gas or city gas. In the LPG rich gas producing operations, a catalyst composition of the 'B' type is employed which contains the hydrogenation-dehydrogenation metal component preferably in a non-aggregated, highly mono dispersed form, in processing steps that permit continuous separation and withdrawal of formed LPG gaseous product from the process. Accordingly, the type 'B' catalyst preferred in this type of operation should contain the metal component in a highly dispersed form. It is also preferred to use a mono-dispersed form of the transition metal element, placed into the interior of the solid of special uniform pore structure, such as a dispersion at the mono-atomic or mono-ionic level which does not give a substantial X-ray diffraction response corresponding to the bulk metal form of the transition element employed. For example, a suitable mono-dispersed form of Ni-chabazite catalyst will not give X-ray diffraction lines corresponding to Ni metal per se. Re-exchangeability of the mono-dispersed metal with another ion, such as calcium for example, in the aqueous phase is often characteristic of this state of the catalyst. Accordingly, this mono-atomic catalyst composition form is therefore in direct contrast to the prior art teaching of metal loaded catalysts where the elements are said to be reduced to the metallic form and X-ray diffraction patterns of the metallic state per se can be obtained.

On the other hand, when it is preferred to produce methane rich gas in preference to LPG product material, the method of operation is preferably characterized by the use of a type 'B' catalyst composition containing the hydrogenation-dehydrogenation metal component in an aggregated form, internal to the pore system of molecular dimension, together with processing steps that permit the continuous separation and withdrawal of methane rich gaseous material produced in the process. In this latter method of operation, the catalyst "B" composition preferably contains one or more metals such as Ni, Pt, Pd or other suitable hydrogenative-dehydrogenative metal component within the uniform pore structure, in a state of metallic aggregation. This catalyst composition may be obtained by various procedures which include introducing a high concentration of metal, such as corresponds to about 30% or more of its ion-exchange capacity; by the introduction of metal as non-ionic species such as by gaseous decomposition of a carbonyl or by heat treating the catalyst containing relatively dispersed metal at sufficiently high temperatures in the presence or absence of steam, oxygen, hydrogen, etx., so as to cause substantial migration and aggregation of elemental units of the transition element used.

The operating conditions employed in the process embodiments of this invention are selected such that a catalyst of type "A" will be exposed to relatively typical reforming operating conditions including temperatures in the range of from about 800° F. to about 1000° F., preferably from about 890 up to about 980° F., liquid hourly space-velocity in the range of from about 0.1 to about 10, preferbly from about 0.5 to about 5; a pressure in the range of from about atmospheric up to about 700 psig and higher, preferably from about 100 to about 600 psig; and a hydrogen-hydrocarbon ratio in the range of from about 0.5 to about 20 and preferably from about 1 to about 10.

On the other hand, the catalyst of type "B" category generally may be employed at operating conditions similar to and within the above-identified operating conditions of a reforming reaction, or in some embodiments at lower temperature and similar or higher pressure conditions. However, one of the important aspects and embodiments of the invention relates to contacting the hydrocarbon reactant stream with both types of catalysts under similar operating conditions. Therefore, it is possible to have embodiments in which the two different types of catalysts are contained in successive beds in one or more reactors in the process stream. Such circumstances provide engineering advantages such as adiabatic operation, avoidance of heaters of coolers between stages of the process, minimum need for interstage compressor or expansion facilities, etc. However, it is also within the scope in some embodiments of this invention to expose type 'B' catalyst to a substantially wider range of operating conditions than is characteristic of a typical reforming operation. Therefore, catalyst type "B" can encounter temperatures in the range of from about 500° to about 1000° F., or higher; pressures from about atmospheric up to as high as about 5000 psig; LHSV in the range of from about 0.1 to about 40 and a hydrogen to hydrocarbon ratio in the range of from about 0.1 to about 40.

The selective conversion relied upon in the contact step involving the catalyst of type "B", was found to proceed under conditions of pressure and temperature which are regarded as either hydrogenative or aromatizing in the thermodynamic sense. Therefore, the operation may be effected at lower temperatures and higher pressure than is generally allowable in the normal reforming operation which is limited to the range of aromatizing conditions, that is for an equilibrium which favors aromatics in the reversable system, naphthenes aromatics. In addition, the temperature of operation applicable to contact with type "B" catalyst will depend on and be correlated to the acidity of the "B" catalyst composition. That is, if it is prepared to contain much acidity internally, or is admixed with external acidic solid, operation at a relatively lower temperature can be achieved.

In any of the arrangements above discussed using crystalline aluminosilicate or zeolite support material for the type "B" catalyst, it is particularly preferred to have a zeolite composition with a silica/aluminum ratio not less than about 2.0 and preferably the ratio should be at least about 3.0.

It should be noted also that the invention involves a cooperative hydrogen economy between the different parts of the conversion process in that hydrogen consumed by the mechanisms operative on catalyst "B" is produced in the derived from the conversion events over catalyst "A".

Shape selective conversion catalysts type "B" suitable for use in the method of this invention were prepared as follows:

Catalyst $B_2$ was prepared from a naturally occurring zeolite (orionite) of about 4 to 6 Angstrom pore size. One part by weight of the crystalline alumino-silicate or zeolite was base-exchanged for about 2 hours at room temperature with about ten (10) parts by weight of 5% $NH_4Cl$ solution. This treatment was repeated three additional times for a total time of the order of about 20 hours with the last treatment being for about 16 hours duration. The residue obtained from this $NH_4Cl$ treatment or base-exchange step was thereafter water washed to remove chloride from the residue and then filtered. The filter cake thus obtained was refluxed with about 25 parts (wt.) of 0.5 N nickel acetate solution for about 10 minutes and then filtered. The filtered solids or residue was then again water washed. The residue thus obtained was dried, pelleted, crushed to about 30/60 mesh size particles and then air calcined at a temperature of about 1000° F. for about 16 hours. A sufficient quantity of the calcined catalyst was placed in a reactor and $H_2$ reduced or activated for about 4 hours at a temperature of about 950° F. and a pressure of about 400 psig. while maintaining fresh flow of $H_2$ rich gas at about 6 SCF/H.

Catalyst $B_3$ was prepared by following the procedure for the preparation of Catalyst $B_2$, but the final nickel content of the catalyst was limited to approximately ½ of that in Catalyst $B_2$.

Catalyst $B_4$ was prepared and dried in the manner identical with that employed to prepare Catalyst $B_3$. However, the dried catalyst was subsequently partially chelated by contacting with an EDTA (ethylene-diamine-tetraacetic acid) to eliminate the surface (macropore) dual functional non-selective properties of Catalyst $B_3$. Analytical data obtained from the catalyst thus treated have shown that the net effect of the chelating treatment is to reduce the nickel content from about 2.5% (of Catalyst $B_3$) to about 2.0% without significantly effecting the alumina content (15.9% for Catalyst D; 16.5% for Catalyst $B_3$).

A more detailed procedure of preparation of the strictly shape-selective Catalyst $B_4$ with pores of 4 to about 5 Angstroms in diameter is described below.

A naturally occurring zeolite (erionite) was ground to 0.024 inch average particle size. The ground or particulated zeolite was continuously base-exchanged for a period of about 6 days with about 5% ammonium chloride solution maintained at a temperature of about 180°F., at a rate of about 120 pounds of ammonium chloride solution per 1.0 lb. of the zeolite particles. The resulting $NH_4$-zeolite was water-washed until free of chloride ions and subsequently air-dried at a temperature of about 230°F. The dried $NH_4$- zeolite was reflux contacted for 10 minutes with 0.5 normal nickel acetate solution, using about 853 cc of the ammonium-zeolite. The resulting slurry was filtered and the filter-cake was water-washed, using two one-liter washes to remove excess nickel-acetate. The washed wet cake was air-dried at a temperature of 230°F. The resulting dried Ni-$NH_4$- zeolite was treated for 10 minutes at a temperature of about 180°F., with about 820g. of chelating soluton per 100g., of the dried Ni-$NH_4$-zeolite, The chelating solution was prepared by adding 11.11g. of EDTA to 1111 ml of water and by addition of $NH_4OH$ to adjust to 6.2 the final ph value of the solution. The resulting chelated Ni-$NH_4$- zeolite was air-dried at a temperature of about 230°F., and subsequently air-calcined for about 10 hours at a temperature of 1050°F. The final product, Catalyst $B_4$, was a chelated Ni-H-zeolite.

The chelated and calcined Catalyst $B_4$ prepared as above-described was reduced to about 1/8⅛ particle size and 40cc of this material was charged to a bench-scale isothermal reactor. The catalyst in the reactor was $N_2$- purged and $H_2$- activated, or treated, with $H_2$-rich gas at the conditions described hereinbefore with respect to the preparation of Catalyst $B_3$.

Catalyst $B_5$ comprising a nickel offretite catalyst was prepared as follows:

One part by weight of offretite was exchanged for two hours at room temperature with 10 parts of 5 normal ammonium chloride and then filtered. This step was repeated three times and the last time the exchange was made overnight for approximately 16 hours. A filter cake was obtained and water-washed and added to 25 parts of refluxing 0.5 N nickel acetate. After ten minutes the material was filtered and again water-washed. This catalyst after drying had the following compositional analysis as shown in examples 11 to 16. A portion of the dried catalyst was pelleted, crushed to 30/60 mesh and calcined at 1000° F. in an oven for about six hours.

FIG. 1 presented herewith and discussed in example 17 presents the yield-octane relationship obtained by the selectoforming process as compared with that obtained by a normal reforming operation.

Figure 2:
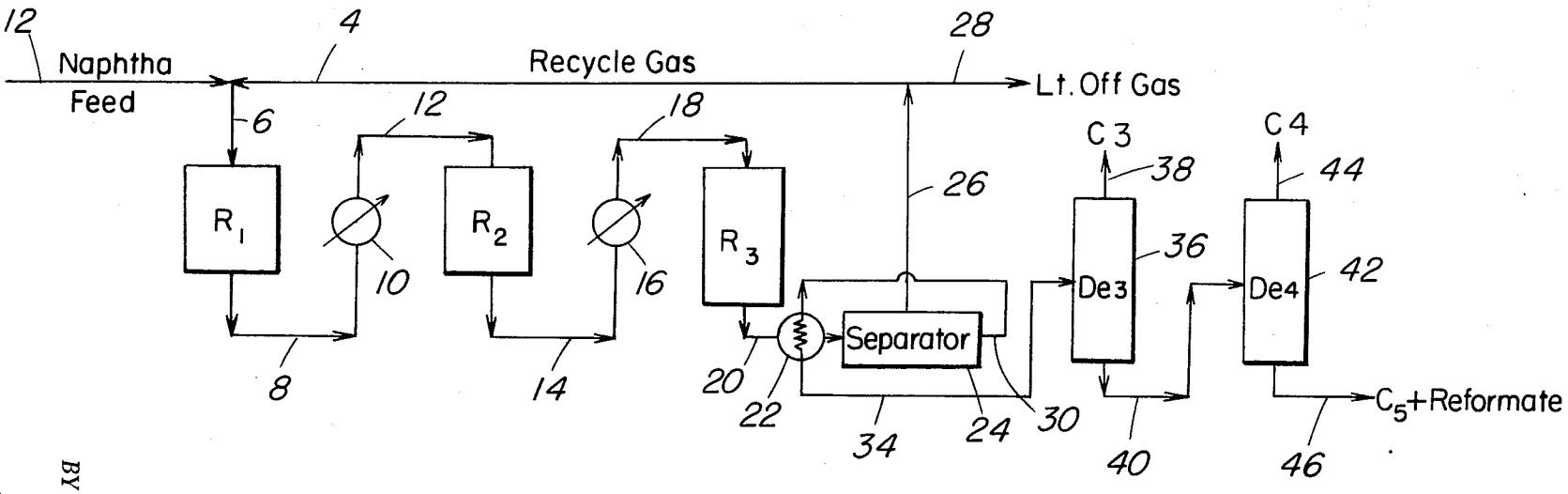

FIG. 2 presented herewith in diagrammatic form shows an arrangement of processing steps for reforming a naphtha charge and selectively upgrading the reformate product thus obtained.

EXAMPLES 1 to 4

Mixtures of a low and a high octane number paraffin hydrocarbon were contacted with various metal zeolite catalysts of this invention to demonstrate enrichment of the high octane component in the contact stream. Two different charge-stocks employed were:

| | | | RON (clear) |
|---|---|---|---|
| A: | n-octane | 50% | 21.7 |
| | iso-octane | 50% | 100.0 |
| B: | n-hexane | 50% | 24.8 |
| | 2-methyl pentane | 50% | 73.8 |

The naphtha test charge was injected as a vapor pulse with hydrogen over the catalyst, a $H_2$/hydrocarbon mole ratio of 37/1, and a LHSV (during hydrocarbon feed) of about 1, at atmospheric pressure, at 900° F. for examples 1 and 2, and at 700° F, in examples 3 and 4.

High conversion to eliminate the low octane number component, and enrichment thereby of the high octane number component was observed, as follows:

| Example | Run No. | Catalyst | Elimination % of Original Charge | | | |
|---|---|---|---|---|---|---|
| | | | Charge Stock A | | Charge Stock B | |
| | | | n-$C_3$ | iso-$C_3$ | N-$C_6$ | iso-$C_6$ |
| 1 | N-1 | Ni-Offretite (4.6% Mi) | 63 | 0 | 15 | 0 |
| 2 | W-4 | Ni-Offretite (.4% Ni) | 58 | 0 | 24 | 0 |
| 3 | A | Ni-Zeolite-A (0.6% Ni) | 77 | 62 | — | — |
| 4 | F | Ni-Chabazite (.76% Ni) | 42 | 0 | — | — |

In examples 1 and 2 the temperature and pressure represent thermodynamically speaking, aromatizing conditions; 900° F. is well within the accepted range of reforming temperature. In examples 3 and 4, the temperature was well outside and below the range employed in reforming operations. The zeolites employed in examples 1 and 2 are characterized by a Si/Al ratio of about 3.0; 2.0 in example 4; 1.0 in example 3. The product selectivity is seen to be relatively poor in example 3.

EXAMPLES 5 to 8

A naphtha boiling range hydrocarbon mixture of 100.1 ON (R + 3) was contacted with a 4.6% wt Ni-offretite catalyst at various conditions of temperature and pressure within the "reforming" range. Conditions and results are summarized below:

| Charge Naphtha Composition: | | |
|---|---|---|
| 10.5% | (vol.) | 2,2 dimethylbutane |
| 6.2 | " | 2,3 dimethylbutane |
| 15.3 | " | 2-methylpentane |
| 5.8 | " | n-hexene |
| 40.8 | " | benzene |
| 21.4 | " | n-hexane |

| | Example No. | 5 | 6 | 7 | 8 |
|---|---|---|---|---|---|
| All runs at 4 LHSV 4 $H_2$/HC Ratio | Pressure, psig | 400 | 400 | 200 | 200 |
| | Temperature, ° F. | 800 | 950 | 800 | 950 |
| Vol. % $C_6$+product | | 66.6 | 61.9 | 77.3 | 67.3 |
| n-$C_6$ converted, mole % of initial | | 91.5 | 86.0 | 73.5 | 82.0 |
| iso-$C_6$ converted, mole % of initial | | 5.2 | 16.1 | 6.0 | 29.0 |
| ON (R + 3) of $C_6$+ product | | 107.8 | 107.5 | 106.4 | 109.1 |

The results of the four examples demonstrate the ON improvement accomplished by the highly preferential conversion of the normal hydrocarbon in contrast to iso-paraffin.

EXAMPLES 9–10

A $C_6$ reformate effluent stream was simulated by the blend listed in column 1 of the table below:

| | (1)Charge | (2)Example 9 | (3)Example 10 |
|---|---|---|---|
| n-hexane | 22.5 | 8.2 | 12.6 |
| 2-methylpentane | 12.2 } 17.1 | 18.4 | 17.8 |
| 2,3 dimethylbutane | 4.9 } | | |
| 2,2 dimethylbutane | 8.4 | 8.3 | 7.8 |
| benzene | 52.9 | 63.3 | 60.5 |
| methyl cyclopentane | — | 1.7 | 1.2 |

The blend has the composition of a reformate, i.e., of a naphtha fraction which has already contacted a Pt-catalyst in a reforming zone. It is essentially a mixture of only aromatic and paraffinic components. This material was then contacted with Ni-offretite catalyst "B" at 2000 psig, 30/1 molar $H_2$/hydrocarbon ratio, at 14 LHSV, at 800° F. The composition of the $C_6$ fraction effluent was found to have the composition shown in column 2 of the above table.

It is to be noted that the low ON component has been greatly reduced in concentration while the concentration of none of the high octane components have substantially dropped.

The above contact was also repeated at a temperature of about 750° F. This example 10, produced the product composition shown in column 3.

It is clear from the data of columns 2 and 3 that the average octane value of the $C_6$ products was raised in both cases. The octane numbers, calculated by standard methods, for the compositions of columns 1, 2 and 3 are 102.4, 106.4 and 105.3, respectively. In ordinary reforming type processing, isoparaffins are eliminated at least as easily as n-paraffins and, therefore, for the same loss of total paraffin volume, the octane number gain would be smaller. It is noteworthy that no aromatics were lost in spite of the fact that the conditions of catalytic conversion, in the presence of a hydrogenation-dehydrogenation metal component would normally favor such hydrogenation, at the conditions of operation.

These data show beyond any reasonable doubt that the downstream conversion of a partially reformed naphtha can also be accomplished at temperature-pressure conditions which lie outside of the thermodynamic range of aromatization conditions. That is, temperatures for this part of the overall naphtha conversion may be lower and pressures may be higher than those typical of reforming conditions per se.

It follows from these and the previous examples that this portion of the process step may be carried out under operating conditions broadly within those of reforming, but also outside of that range of conditions.

EXAMPLES 11–16

A nickel offretite catalyst used in the present study was prepared and had the following compositional analysis (when analyses are expressed in terms of equivalent oxides composition):

| | Wt % |
|---|---|
| NiO | 5.9 |
| $SiO_2$ | 72.5 |
| $Al_2O_3$ | 17.4 |
| $K_2O$ | 4.1 |
| CaO | 3.1 |
| $Fe_2O_3$ | 2.4 |
| MgO | 0.2 |
| $Na_2O$ | 0.1 |
| | 105.7 |

A portion of the dried catalyst was pelleted, crushed to 30/60 mesh particle size and calcined at 1000°F., in an oven overnight (about 6 hours). Two and one half cc (1.1 g) were charged to a 10 cc cylindrical pressure reactor, and activated with hydrogen at 800°F., atmospheric pressure for one hour. At the end of each run, the catalyst was purged with the same flow rate of hydrogen for 1–2 hours, while the reactor was cooled to 500°F., and left blocked at 2000 psi overnight.

A 1/1 weight blend of n-octane/2,2,4-trimethyl pentane, 30/1 ml ration $H_2$/hydrocarbons, was charged over the catalyst at 2000 psig, 750–800°F., 2–14 LHSV, with the following results:

| Example No. | 11 | 12 | 13 | 14 | 15 | 16 |
|---|---|---|---|---|---|---|
| Run No. | 1 | 2 | 3 | 4 | 5 | 6 |
| Temp., ° F. | 800 | 800 | 800 | 800 | 800 | 750 |
| DMSV | 2 | 3 | 4 | 5 | 14 | 14 |
| Time, Hrs. | 1 | 1 | 1 | 2 | ½ | ½ |
| Conversion, wt % | | | | | | |
| Overall | — | — | — | 55.5 | 45.9 | 15.2 |
| n-Octane | 100 | 100 | 100 | 100.0 | 86.5 | 30.4 |
| iso-Octane | — | — | — | 11.0 | 5.3 | nil |
| Material Balance | — | — | — | — | 97.9 | 99.1 |

The liquid products in the first three runs contained only iso-octane. The last two runs for which complete material balances were made showed major products to be propane, butanes and some pentanes - the butanes were 93% normal, and the pentanes 83% normal. Catalytic shape selectivity is clearly demonstrated by the above results. The selective conversion to a higher octane number product is clearly shown.

EXAMPLE 17

A $C_4$-360° F. Mid-Continent naphtha was processed by initially contacting the same with a platinum alumina reforming catalyst under reforming conditions of 500 psig pressure at a reforming severity adjusted to give a 90 ON (R+3) intermediate product composition for the $C_5$+ portion. With the portion of material lighter than $C_6$ removed, the naphtha was then further contacted with a 2.5% Ni-offretite catalyst; this contact was carried out at 500 psig, a $H_2$/HC ratio of about 10:1 and a series of inlet temperature severities from 900°F. to 940° F. The liquid volume yields final product from the successive contacting was determined, as well as the (R+3) ON of that product. The resulting yield-octane relationship was compared with the yield-octane relationship obtained by conventional 500 psig pressure reforming of the same Mid-Continent naphtha over a platinum reforming catalyst alone. The comparison is shown in FIG. 1 attached.

The $C_6$+ product yield obtained by selectoforming, the new process (marked "process"), and the $C_6$+ product yield from conventional reforming (marked "std. reforming") are shown as curves A in FIG. 1. They demonstrate the ability of the new process to give higher volume yields for a given target ON to be achieved. The curves also show that this process is specifically applicable to a range of high target octane numbers, namely those near and above a level of about 100 ON (R+3).

When the portion lighter than $C_6$ is blended back into the product, the overall yield comparison, now for $C_5$+ product yield is shown in curves B. The advantage of the new process remains evident.

EXAMPLES 18–19

A $C_6$ hydrocarbon blend simulating a Kuwait $C_6$-250° F. naphtha, and having an octane number (R+3) of 83.3 was contacted sequentially at 200 psig, 950° F., 6.0 $H_2$/hydrocarbon, 1.33 LHSV, with two types of catalyst charges:

A. 2 vol. of a platinum alumina reforming catalyst. upstream + 1 vol. of 4.6% Ni-offretite downstream, B. 2 vol. of a platinum-alumina reforming catalyst upstream + 1 vol. of Pt-CaA zeolite downstream.

The product yields and product octane numbers are compared below. In each case there was a significant improvement in ON.

| | Example 18 A Ni-Offretite | Example 19 B Pt-CaA |
|---|---|---|
| $C_5$+ ON (R + 3) | 101.3 | 100.5 |
| $C_5$+ vol % yield | 56.7 | 57.6 |
| $C_6$+ ON (R + 3) | 101.8 | 102.0 |
| $C_6$+ vol % yield | 51.5 | 47.9 |

EXAMPLE 20

A $C_6$ reformate effluent stream similar in composition to that given in Examples 9–10 simulating a naphtha intermediate obtained from contacting a naphtha feed with a platinum reforming catalyst, is contacted with a pelleted catalyst consisting of a mechanical mixture of Ni-offretite catalyst (as in Examples 9–10) and an amorphous silica-alumina cracking catalyst, at conditions as in Examples 9–10. While in Examples 9–10 the concentration of aromatics in the product increased to a level of 60 to 63%, the aromatics concentration in the presently described example is found to increase to a value in excess of 70%. At the same time the concentrations of both n-paraffin and iso-paraffin are found to be markedly reduced.

As further examples of the improved method and process of this invention, the following Tables of data are presented which provide comparative data of results obtained upon upgrading different naphtha feeds by (1) a conventional piror art three reactor reforming method, (2) a combined operation of the method of this invention wherein the selective conversion catalyst is retained along with platinum reforming catalyst in the third reactor of a three reactor reforming process and (3) an operation similar to (2) above except that the selective conversion catalyst is retained in a separate fourth reactor downstream of the third reforming reactor. Table I below presents a comparative product distribution obtained when processing a $C_6$ – 350° F. Aramco naphtha at 500 psig under conditions to produce both 102 and 104 $C_5$+ (R+3) ON product.

TABLE I

COMPARISON

PRODUCT DISTRIBUTION, PROCESSING $C_6$ - 350° F. Aramco Naphtha, 500 PSIG

| $C_5$ + R + 3 ON | 102 | | | 104 | | |
|---|---|---|---|---|---|---|
| | Conv. | Comb. | Sep* | Conv. | Comp. | Sep* |
| $C_6$ + | 59.2 | 63.0 | 62.2 | 52.0 | 59.0 | 56.0 |
| $C_5$ + | 70.0 | 69.6 | 70.0 | 63.7 | 65.0 | 65.7 |
| 1 $C_5$ | 6.3 | 5.6 | 4.8 | 6.0 | 6.0 | 6.0 |
| n $C_5$ | 4.5 | 1.0 | 3.0 | 4.9 | 2.9 | 3.7 |
| Total $C_5$ | 10.8 | 6.6 | 7.8 | 11.7 | 6.9 | 9.7 |
| 1 $C_4$ | 5.2 | 4.0 | 5.0 | 6.2 | 4.5 | 5.9 |
| n $C_4$ | 7.4 | 4.1 | 5.8 | 0.3 | 1.9 | 6.8 |
| Total $C_4$ | 12.6 | 8.1 | 10.8 | 14.5 | 8.3 | 12.7 |
| $C_3$ | 8.4 | 12.1 | 11.9 | 10.3 | 13.3 | 12.8 |
| $C_2$ | 5.2 | 5.2 | 3.6 | 6.6 | 6.0 | 4.6 |
| $C_1$ | 2.2 | 2.6 | 1.6 | 2.8 | 3.5 | 2.2 |
| Total $C_1$–$C_3$ | 15.8 | 19.9 | 17.1 | 19.8 | 22.8 | 19.6 |
| $H_2$, SCFB | 450 | 280 | 310 | 450 | 310 | 340 |
| Reformer $H_2$ Purity, Mol % | 69 | 61 | 78 | 62 | 58 | 73 |

*ESTIMATED

Table II below presents a comparative product distribution obtained when processing a $C_6$-380° F. Mid Continent Naphtha at 500 psig under conditions to produce both 102 and 104 $C_5$+(R+3) ON product.

TABLE II

COMPARISON PRODUCT DISTRIBUTION PROCESSING $C_6$ - 380° F. Mid Continent, 500 PSIG, No Driers

| $C_5$+ (R + 3) O.N. | | 102 | | | 104 | | |
|---|---|---|---|---|---|---|---|
| | | Conv. | Comb. | Sep.* | Conv. | Comb. | Sep.* |
| $C_6$+ | Vol. % | 67.1 | 68.6 | 68.6 | 59.8 | 64.3 | 62.8 |
| $C_5$+ | " | 75.9 | 72.3 | 74.0 | 71.2 | 63.8 | 70.0 |
| 1 $C_6$ | " | 5.8 | 3.2 | 3.6 | 7.4 | 4.1 | 4.7 |
| n $C_5$ | " | 3.0 | 0.5 | 1.8 | 4.0 | 0.4 | 2.5 |
| Total $C_5$ | " | 8.8 | 3.7 | 5.4 | 11.4 | 4.5 | 7.2 |
| 1 $C_4$ | " | 3.8 | 2.1 | 3.9 | 4.6 | 3.3 | 4.9 |
| N $C_4$ | " | 5.4 | 2.0 | 3.4 | 6.5 | 1.6 | 4.6 |
| Total $C_4$ | " | 9.2 | 4.1 | 7.3 | 11.1 | 4.9 | 9.5 |
| $C_3$ | Wt. % | 6.1 | 9.9 | 10.6 | 7.1 | 10.4 | 11.5 |
| $C_2$ | " | 3.5 | 4.9 | 2.4 | 4.7 | 6.1 | 3.2 |
| $C_1$ | " | 1.9 | 3.3 | 1.6 | 2.8 | 4.8 | 1.7 |
| Total $C_1$–$C_3$ | " | 11.5 | 18.6 | 14.6 | 14.6 | 21.3 | 16.4 |
| $H_2$, SCPB | | 780 | 520 | 630 | 780 | 550 | 680 |
| Reformer $H_2$ Purity, Mol % | | 79 | 66 | 83 | 74 | 64 | 80 |

*ESTIMATED

Table III below presents a comparison of product distribution obtained by conventional and combined reforming as described above when processing an N $C_4$-360° F. Mid-Continent Naphtha at 500 psig to produce 102 $C_5$+ (R+3) ON product.

TABLE III

COMPARISON PRODUCT DISTRIBUTION PROCESSING

| $C_5$ + (R + 3) ON | N $C_4$-360° F. MC, 500 PSIG 102 | |
|---|---|---|
| | Conv. | Comb. |
| $C_5$ + | 68.4 | 69.4 |
| $C_6$ + | 52.0 | 60.2 |
| 1$C_5$ | 10.3 | 7.7 |
| N $C_5$ | 5.5 | 1.5 |
| Total $C_5$ | 16.4 | 9.2 |
| 1 $C_4$ | 6.3 | 3.0 |
| N $C_4$ | 9.1 | 4.0 |
| Total $C_4$ | 15.4 | 7.0 |
| $C_3$ | 7.7 | 12.4 |
| $C_1$–$C_2$ | 7.2 | 7.6 |
| Total $C_1$–$C_2$ | 14.9 | 20.0 |
| $H_2$ SCFB | 480 | 440 |
| Reformer $H_2$ Purity, Mol % | 66 | 64 |

It is demonstrated by the data presented in the above Tables that the yields of $C_6$+ product were higher for the combined and separate processing methods over that obtainable by a conventional reforming operation. The data further show selective conversion of n-paraffins in the process by virtue of the higher yields of $C_3$ hydrocarbons over that obtained by conventional reforming operations. In Table I, substantially higher yields of $C_5$+ product were obtained when processing to 104 ON product by the combination and separate processing routes over that obtained by conventional reforming. It should also be noted that significant improvement in yields of $C_3$ was also obtained. Table III on the other hand, shows that the combination processing method of this invention realized significant improvements for both $C_5$+ and $C_6$+ products over conventional reforming. Furthermore, the combination processing route also produced higher yields of $C_3$ hydrocarbons than obtained by conventional reforming.

Having thus generally described the improved methods of this invention and provided examples directed thereto, reference is now had to the drawing (FIG. 2) which provides one arrangement of contacting steps for practicing the invention described.

Referring now to FIG. 2 by way of example, a process flow arrangement is diagrammatically shown comprising a three reactor, ($R_1$, $R_2$ and $R_3$) reforming system, a reformate product separator, a depropanizer tower and a debutanizer tower from which a $C_5$+ reformate product can be recovered. The naphtha boiling range hydrocarbon feed enters the process by conduit 2, is combined with a hydrogen rich recycle gas in conduit 4 and passed by conduit 6 to reforming reactor $R_1$. The naphtha feed may be brought up to reforming temperatures in a suitable heater now shown either before or after admixture with the hydrogen rich recycle gas, so that it has an inlet temperature sufficiently high to provide the endothermic reaction heat required in $R_1$. The combined stream of hydrogen and hydrocarbon flows in series through $R_1$, conduit 8, heater 10, conduit 12, reactor $R_2$, conduit 14, heater 16, conduit 18 to reactor $R_3$. In this arrangement $R_3$ houses a portion of a platinum type reforming catalyst in upstream portion of the reactor and the selective type "B" catalyst described above in the downstream portion of the reactor.

In reactor $R_3$, the total reformate product moves in contact with the selective upgrading catalyst under conditions to obtain the selective conversion of hydrocarbons described above. The total product effluent of reactor $R_3$ is thereafter passed to a suitable separator vessel 24 by conduit 20 containing heat exchanger 22. In separator 24, a hydrogen rich recycle gas stream is separated from the remaining reformate product and removed by conduit 26 for recycle to conduit 4. A portion of this recycle gas may be withdrawn by conduit 28. The remaining reformate product is removed by separator 24 by conduit 30, passed through heat exchanger 22 and then through conduit 34 to a depropanizer tower 36. In tower 36, $C_3$ and lighter hydrocarbons are separated and removed by conduit 33 from the reformate product. The depropanized effluent is the passed by conduit 40 to a debutanized tower 42. Butane rich gas is recovered from tower 42 by conduit 44 and a $C_5$+ reformate rich in aromatics and branch chained by hydrocarbons is recovered by conduit 46. The sensible heat of the product stream of $R_3$ may be utilized to preheat the fresh naphtha feeds passed to the process by heat exchange in heat exchange 22.

The reactions involving the selective upgrading catalyst portion of the process result in a liberation of heat; it is contemplated therefore, that interspacing of selective type "B" catalyst with the reforming type catalyst in any reactor in the series of reactors can be practiced in a manner to take advantage of this heat liberation. Accordingly, some portions of catalyst type "B" change can be included in reactors preceding reactor $R_3$. This will be particularly advantageous when the objective of the process is the production of aromatics concentrates.

The charge stock selected for passage through the selectoforming process, in any of its varied embodiments described may be especially selected in composition or in boiling range so as to obtain maximum benefits from the process. For example, it has been pointed out that the advantages in product yield of the new upgrading process and method are greatest for a paraffinic as compared to a highly naphthenic charge stock. If various naphthas are to be reformed it will advantageous to process at least portions of the more naphthenic stocks only over reforming catalyst reactors while passing the more paraffinic charge stock through a selectoforming train of catalysts.

It is contemplated, for example, to process naphthenic charge stocks only over type "A" catalyst contained in portions of the processing system, and more paraffinic charge stocks through the entire sequence of catalyst in the reactor system in, for example, a blocked out operation.

Also, processing in the selectoforming reactor system of this invention may be advantageously confined to the naphtha portion boiling substantially above about $C_5$ hydrocarbon since n-pentane is well known to have an adequately high octane number and therefore curbing a need for further conversion or elimination from the product. Also, a $C_6$ to approximately $C_8$ cut of naphtha may be selected as feed for preferential treatment by the selective process. For example, after contact with type A catalyst the intermediate product may be split into an approximate $C_9$+ and a $C_8$- portion; the $C_9$+, or the higher boiling portion removed from the train while the $C_8$−, or lower boiling portion is allowed to proceed to contact type B catalyst. Alternatively, we may provide a separation of the selectoforming product stream into desired portions of specific boiling range, and recycle one or more portions of the separated reaction products to a bed of catalyst or reactor containing at least a majority portion of type "B" catalyst. Clearly, selection of product streams for recycle of the cuts of highest paraffin content, or the cuts having the lowest octane number due to presence of n-hydrocarbons will be most advantageous.

Having thus provided a general description of the invention and presented several examples in support thereof, it is to be understood tht no undue restrictions are to be imposed by reason thereof.

What is claimed is:

1. The process for upgrading naphtha so as to produce a product enriched in aromatics which comprises:

a. contacting a charge naphtha in the presence of hydrogen with a reforming catalyst to yield hydrocarbon products;

b. passing hydrocarbon products of said reforming step in admixture with hydrogen in contact with a catalyst mixture comprising:

1. a shape selective crystalline aluminosilicate hydrocracking catalyst having a silica to alumina ratio of at least 3.0, a pore size of about 4.5 to 6 Angstrom units and having hydrogenation/dehydrogenation activity, and

2. a reforming catalyst.

2. The process for upgrading naphtha so as to produce a product enriched in aromatics which comprises:

a. contacting a charge naphtha in the presence of hydrogen with a reforming catalyst to yield hydrocarbon products;

b. thereafter passing hydrocarbon products of said reforming step consisting essentially of a mixture of aromatic and paraffinic components in admixture with hydrogen in contact with a catalyst mixture comprising:

1. an ammonium and nickel exchanged erionite, and

2. a reforming catalyst.

3. An improved process for selectively removing straight chain hydrocarbons from a hydroformed naphtha product stream which comprises selectively hydrocracking said feed by contact at elevated temperature and pressure and in the presence of hydrogen with a catalyst comprising erionite combined with a metallic hydrogenation component, said erionite having a potassium content determined as potassium oxide of 4.1 weight percent.

4. An improved process for selectively removing straight chain hydrocarbons from a previously hydroformed hydrocarbon feed stream which comprises contacting said hydrocarbon feed at elevated temperature and pressure and in the presence of hydrogen with a catalyst comprising a metallic hydrogenation component combined with erionite, said erionite having been cation exchanged at a temperature of 180° F.

* * * * *

UNITED STATES PATENT AND TRADEMARK OFFICE

CERTIFICATE OF CORRECTION

PATENT NO. : 4,032,431

DATED : June 28, 1977

INVENTOR(S) : PAUL B. WEISZ

It is certified that error appears in the above-identified patent and that said Letters Patent are hereby corrected as shown below:

| | |
|---|---|
| Column 1, line 16 | "particalarly" should be -- particularly --. |
| Column 1, line 39 | after volume "of" should be -- or -- |
| Column 2, line 67 | after "zirconium" add -- thorium --. |
| Column 3, line 18 | "0.6" should be -- 0.6% --. |
| Column 3, line 28 | "on-steam" should be -- on stream -- |
| Column 3, line 50 | "of" should be -- or --. |
| Column 4, line 35 | "crystaline" should be -- -- crystalline --. |
| Column 4, line 39 | "structure" should be -- structures --. |
| Column 4, line 41 | after "naturally" add -- : --. |
| Column 4, lines 49 & 50 | "Offretite-38." should be -- Offretite". --. |
| Column 4, line 59 | "transistion" should be -- transition --. |
| Column 6, line 43 | after "from" add -- the --. |
| Column 6, line 66 | "presnce" should be -- presence --. |
| Column 8, lines 9 & 10 | after "isomerization" add -- type -- |
| Column 8, line 28 | "catalyst" should be -- catalytic -- |

UNITED STATES PATENT AND TRADEMARK OFFICE

CERTIFICATE OF CORRECTION

PATENT NO. : 4,032,431

DATED : June 28, 1977

INVENTOR(S) : PAUL B. WEISZ

It is certified that error appears in the above-identified patent and that said Letters Patent are hereby corrected as shown below:

| | |
|---|---|
| Column 8, line 58 | after invention "." should be --,--. |
| Column 9, line 15 | "concentration" should be -- concentrates --. |
| Column 10, lines 51 & 52 | after "naphthenes" insert -- $\longleftrightarrow$ --. |
| Column 11, line 1 | after in "the" should be -- and --. |
| Column 11, line 63 | after "of the" add -- solution per 100 g. of the --. |
| Column 12, line 13 | "1/8$^{1/8}$" should be -- 1/8" --. |
| Column 13 (1st table) | under Charge Stock A, "n-$C_3$" should be -- n-$C_8$ --. |
| " " " " | under Catalyst "Ni-Offretite (4.6% Mi)" should be -- Ni-Offretite (4.6% Ni) --. |
| " " " " | Example 1, under Charge Stock A "63" should be -- 68 --. |
| Column 13 (2nd table) | In the heading "Example Mo." should be -- Example No. --. |
| Column 15, line 34 | "800°F" should be -- 900°F --. |
| Column 15, line 40 | "ration" should be -- ratio --. |
| Column 15 (2nd table) | under Example No. "DMSV" should be - LHSV --. |
| Column 15, line 68 | "90" should be -- 99 --. |

UNITED STATES PATENT AND TRADEMARK OFFICE

CERTIFICATE OF CORRECTION

PATENT NO. : 4,032,431

DATED : June 28, 1977

INVENTOR(S) : PAUL B. WEISZ

It is certified that error appears in the above-identified patent and that said Letters Patent are hereby corrected as shown below:

| | |
|---|---|
| Column 17, line 67 | "piror" should be -- prior --. |
| Column 18 (Table I) | under 104, Conv.:<br>1 $C_5$ "6.0" should be -- 6.9 --.<br>n $C_5$ "4.9" should be -- 4.8 --.<br>n $C_4$ "0.3" should be -- 8.3 --.<br>$C_1$ "2.8" should be -- 2.9 --. |
| " " " " | under 104, "Comp." should be --Comb.--<br>$C_5$+ "65.0" should be -- 65.9 --.<br>n$C_5$ " 2.9" should be -- 0.9 --.<br>n$C_4$ " 1.9" should be -- 3.8 --. |
| Column 18 (Table II) | In left column "1 $C_6$" should be -- 1 $C_5$ --. |
| " " " " | In left column "$H_2$, SCPB" should be -- $H_2$, SCFB --. |
| " " " " | before Total $C_4$ "5.4", "3.4", "6.5" and "1.6" should be underlined. |
| " " " " | under 102, "Comb."<br>$C_1$ "3.3" should be -- 3.8 --. |
| " " " " | under 104, "Comb."<br>$C_5$+ "63.8" should be -- 68.8 --. |
| Column 19 (Table III) | under "Conv."<br>1$C_5$ "10.3" should be -- 10.8 --.<br>n $C_5$ " 5.5" should be -- 5.6 --. |
| Column 20, line 19 | "33" should be -- 38 --. |

UNITED STATES PATENT AND TRADEMARK OFFICE

CERTIFICATE OF CORRECTION

PATENT NO. : 4,032,431

DATED : June 28, 1977

INVENTOR(S) : PAUL B. WEISZ

It is certified that error appears in the above-identified patent and that said Letters Patent are hereby corrected as shown below:

| | |
|---|---|
| Column 20, line 21 | "the" should be -- then --. |
| Column 20, line 24 | after "chained" omit -- by --. |
| Column 21, line 16 | "tht" should be -- that --. |

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*